US007134953B2

(12) United States Patent
Reinke

(10) Patent No.: US 7,134,953 B2
(45) Date of Patent: Nov. 14, 2006

(54) ENDLESS ABRASIVE BELT AND METHOD OF MAKING THE SAME

(75) Inventor: Paul R. Reinke, Prairie du Chien, WI (US)

(73) Assignee: 3M Innovative Properties Company, St. Paul, MN (US)

( * ) Notice: Subject to any disclaimer, the term of this patent is extended or adjusted under 35 U.S.C. 154(b) by 137 days.

(21) Appl. No.: 11/022,961

(22) Filed: Dec. 27, 2004

(65) Prior Publication Data

US 2006/0141918 A1 Jun. 29, 2006

(51) Int. Cl.
*B24D 11/00* (2006.01)

(52) U.S. Cl. ..... 451/530; 451/531; 451/532; 451/533; 451/538; 51/294

(58) Field of Classification Search ..... 451/28, 451/59, 296, 526, 530, 531, 532, 533, 536, 451/538; 51/294, 295
See application file for complete search history.

(56) References Cited

U.S. PATENT DOCUMENTS

| | | | | |
|---|---|---|---|---|
| 2,391,731 | A | 12/1945 | Miller et al. | |
| 2,445,807 | A * | 7/1948 | Summers et al. | 451/531 |
| 2,733,181 | A | 1/1956 | Riedesel | |
| 2,794,726 | A | 6/1957 | Riedesel et al. | |
| 3,154,897 | A | 11/1964 | Howard | |
| 3,643,387 | A * | 2/1972 | Hildebrand | 451/531 |
| 3,763,604 | A * | 10/1973 | Malloy | 451/531 |
| 4,082,521 | A | 4/1978 | McGarvey | |
| 4,215,516 | A | 8/1980 | Huschle et al. | |
| 4,486,200 | A * | 12/1984 | Heyer et al. | 51/295 |
| 4,736,549 | A * | 4/1988 | Toillie | 451/531 |
| 5,256,227 | A | 10/1993 | Roelofs | |
| 5,305,560 | A | 4/1994 | Roelofs | |
| 5,341,609 | A | 8/1994 | Gorsuch et al. | |
| 5,482,756 | A | 1/1996 | Berger et al. | |
| 5,573,844 | A * | 11/1996 | Donovan et al. | 442/183 |
| 5,591,239 | A * | 1/1997 | Larson et al. | 51/294 |
| 5,595,804 | A | 1/1997 | Korbel | |
| 5,840,141 | A * | 11/1998 | Korbel | 156/153 |
| 5,858,140 | A * | 1/1999 | Berger et al. | 156/62.2 |
| 6,207,246 | B1 * | 3/2001 | Moren et al. | 428/43 |
| 2004/0018802 | A1 * | 1/2004 | Welygan et al. | 451/28 |
| 2004/0020133 | A1 * | 2/2004 | Paxton et al. | 51/307 |
| 2004/0029511 | A1 * | 2/2004 | Kincaid et al. | 451/526 |
| 2004/0098923 | A1 * | 5/2004 | Hood et al. | 51/296 |

FOREIGN PATENT DOCUMENTS

| | | |
|---|---|---|
| EP | 0 142 140 | 5/1985 |
| EP | 529833 | * 3/1993 |
| WO | WO 86/06671 | 11/1986 |

* cited by examiner

*Primary Examiner*—Eileen P. Morgan
(74) *Attorney, Agent, or Firm*—Gregory D. Allen

(57) ABSTRACT

Endless abrasive belt useful for polishing or otherwise abrading surfaces.

20 Claims, 1 Drawing Sheet

ENDLESS ABRASIVE BELT AND METHOD OF MAKING THE SAME

BACKGROUND

Nonwoven three-dimensional fibrous abrasive products have been employed to remove corrosion, surface defects, burrs, and impart desirable surface finishes on various articles of aluminum, brass, copper, steel, wood, and the like. There has been a continuing desire to increase the useful life of nonwoven three-dimensional fibrous endless abrasive belts, and for spliced endless belts, including increasing the life of the splice securing ends of the belt together.

SUMMARY

The invention provides an endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

a continuous polymeric layer attached to and substantially covering one major surface of the nonwoven layer except for regions adjacent the first and second ends, said first and second ends having first and second major surface areas, respectively;

a cloth strip adhesively attached to the first and second major surface areas to secure the first and second ends together, the cloth strip having an outer major surface; and a polymeric strip adhesively attached to and substantially covering the outer major surface of the cloth tape.

Endless abrasive belts according to the present invention are useful for abrading surfaces of substrates (e.g., substrates made, for example, of aluminum, brass, copper, steel, and wood). Embodiments of endless abrasive belts according to the present invention have an increased life of the splice securing ends of the belt together.

DETAILED DESCRIPTION

Figure 1:
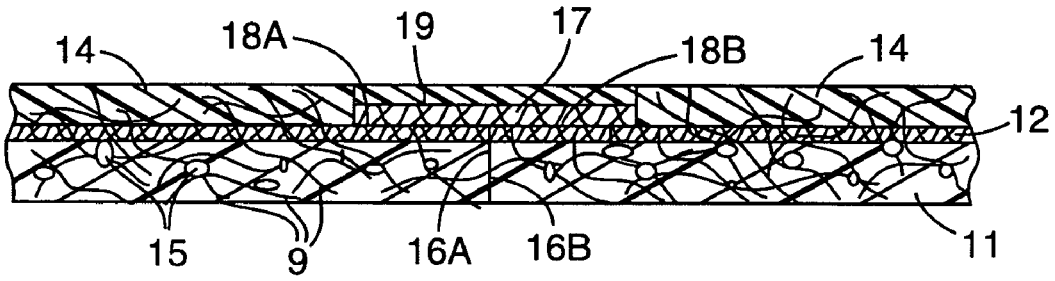
FIG. 1 is a cross-sectional view of a portion of an exemplary endless abrasive belt according to the present invention.

Referring the FIG. 1, a portion of an exemplary endless according to the present invention. Endless abrasive belt according to the present invention 10 comprises three-dimensional fibrous layer 11, optional reinforcing fabric (e.g., scrim) 12, and polymeric layer 14. Abrasive particles 15 are attached to fibers 9 of layer 10 with binder material. Ends 16A and 16B are secured together with cloth strip 17 adhesively attached to surfaces 18A and 18B, and polymeric strip adhesively attached to surface 19. As shown, polymeric layer 14 encapsulates fibrous layer 11 and optional reinforcing fabric 12.

Suitable lofty, open (low-density), fibrous, nonwoven webs for the lofty, open fibrous, nonwoven three-dimensional layer are well known in the art, and may be of any synthetic fiber such as nylon, polyester, etc. capable of withstanding the temperatures at which the impregnating resins and binder materials are cured without deterioration. Exemplary fibers include those that are texturized and crimped. Fibers found satisfactory for the nonwoven portion are typically about 20 mm to about 100 mm, (in some embodiments, about 40 mm to about 65 mm) in length and have a denier of about 1.5 to about 500 (in some embodiments, 15 to 100). If desired, fibers of mixed denier may be used to obtain a desired surface finish. Also, use of larger fibers permits the employment of larger abrasive particles. The nonwoven web can be readily formed, for example, on a "Rando Webber" machine (commercially available from Rando Machine Corporation, Macedon, N.Y.) or other conventional carding processes. In some embodiments the fibrous portion of the endless abrasive belt comprises at least about 225 g/m$^2$ (in some embodiments, about 225 g/m$^2$ to about 275 g/m$^2$, preferably, about 250 g/m$^2$). Although useful, lesser amounts of fiber tend to provide abrasive belts having a somewhat lower commercial work life. These fiber weights typically provide a web, before needling or impregnation, of a thickness of about 6 to about 75 mm (in some embodiments, about 25 mm).

The nonwoven web can be secured to the optional reinforcing fabric (e.g., scrim) via needle tacking. Needle tacking is a conventional method of attaching nonwoven webs to a fabric (typically a woven cloth). A barbed needle passes through the nonwoven web and penetrates the fabric, the barbed needle pulling along fibers of the nonwoven web. The needle thereafter is retracted, leaving individual or collections of fibers of the web attached to the fabric. The amount or degree of needle tacking found necessary to provide useful abrasive articles is typically at least about 8 (in some embodiments, about 20) needle penetrations per cm$^2$ of web surface when 15'18'25'3.5 RB 6-32-5.5/B/3B/2E needles (commercially available from the Foster Needle Company, Manitowoc, Wis. are used. The needle tacking is readily accomplished by the use of conventional needle looms which are commercially available, for example, from the Oskar Dilo Maschinenfabrik KG, Eberbach, Germany.

The nonwoven web can be impregnated, for example, with a resin-abrasive slurry to thoroughly saturate the nonwoven and woven cloth fibers. The dried resin aids in securing the nonwoven fibers to the woven cloth backing. The resins are typically those which are relatively hard and which provide firm bonding of the nonwoven fibers to each other and the woven cloth backing. Exemplary resins found satisfactory include phenol-formaldehyde, epoxy, polyurethane, urea-formaldehyde, and other resins which are commonly utilized in making nonwoven, low density abrasives. The top surface can be coated with resin-abrasive slurry by spray coating or other coating techniques. It is typically desirable that the nonwoven surface have a Shore A durometer of about 25 to about 85 as measured with a 5 mm diameter instrument foot. A lower durometer measurement tends to result in abrasive belts more easily snagged and torn by sharp corners of the articles being finished. Higher durometer measurements tend to result in excessively dense, load up with pieces of abradant.

Exemplary abrasive particles include those ANSI 24 grade and finer and the like (e.g., FEPA and JIS graded abrasive particles) that are typically used for a finishing operation and comprise aluminum oxide, silicon carbide, talc, cerium oxide, garnet, flint, emery, etc. Optionally, commonly used metal working lubricants such as greases, oils, stearates, and the like may be incorporated into the three-dimensional layer.

In some embodiments, the reinforcing fabric (e.g., scrim) is a woven stretch resistant fabric having a low stretch value when pulled in opposite directions. The stretch value is desirably less than about 5% (in some embodiments, less than about 2.5%) when subjected to $175'10^2$ Newtons stress per lineal meter width. Typically, the reinforcing fabric has a thickness in a range from about 0.003 inch to about 0.005 inch (in some embodiments, about 0.004 inch), although thickness outside this range may also be useful. Exemplary materials for the reinforcing fabric are conventional woven cloth backing materials utilized in coated abrasive products. Such woven backing materials include woven nylon, polyester or cotton cloth exemplified by drills, jeans or greige cloth fabric with polyester greige cloth being preferred. Such fabrics are typically treated with a sizing agent, such treatment often being desirable to produce the endless abrasive belts according to the present invention. The fabric should be selected so that it is compatible with solvents, binders and process conditions utilized in the preparation of the endless abrasive belt according to the present invention. Reinforcing fabrics are commercially available, for example, from Milliken & Company, LaGrange, Ga.

Typically, it is desirable for the polymeric layer to impregnate and encapsulate the fibrous backside of the nonwoven web. Hence, it is typically desirable to utilize a fluid composition as the binder precursor that flows around the fibrous back side and hardens in a controlled manner to form a reinforcing, thick, continuous layer which encapsulates one outer surface of the web without significant penetration throughout the balance of the nonwoven web. The resultant composite tends to exhibit increased stiffness and durability with enhanced utility when compared with similar nonwoven, open, three-dimensional products. The polymeric layer can be polymerized in situ from liquid reactive components, or a polymeric material that can be sufficiently fluidized by melt extrusion, can form a coatable, hardenable composition to encapsulate the fibrous web. The term "hardenable" is meant to denote any form of hardening a polymer to a solid material at room temperature. Hardening in situ occurs by curing a reactive system after coating the system on the nonwoven or woven material. Curing can be accomplished, for example, by UV, peroxides or any other known curing methods. Hardening after melt extrusion occurs when the polymer solidifies at room temperature. Generally, when the nonwoven, low density, three-dimensional web contains a reinforcing mesh or woven cloth, a portion of the fibers penetrate through the mesh or woven cloth. The polymeric layer should be sufficiently thick to intimately contact the cloth and encapsulate the fibers protruding through the cloth such that the fibers terminate in the polymeric layer to produce a smooth, "fiber protruding free" surface opposite the nonwoven working face. By the terms "fiber protruding free" and "terminating in the polymeric layer", it is meant substantially all of the fibers extending from the web terminate in the polymeric layer and do not extend out of the surface of the polymer layer opposite that to which the web is adhered.

For better performance, the hardness of the continuous polymer layer is desirably from about Shore 50 A to a Shore 80 D (in some embodiments, in a range of about Shore 90 A to Shore 70 D). Materials softer than about Shore 90 A may have excessive friction and cause heat buildup in some use applications which may result in thermal degradation of the polymer layer. When the polymer is harder than about Shore 70 D the composite may be too stiff for applications such as abrasive belts. In some abrasive disc applications, however, it may be desirable to have the composite be somewhat less flexible.

The thickness of the continuous polymer layer is typically in a range from about 175 micrometers to about 1750 micrometers (in some embodiments, in a range from about 250 to about 1000 micrometers). Polymer layers having a thickness significantly less than about 250 micrometers tend to have insufficient integrity and durability. If the polymeric layer is thicker than about 1000 micrometers, the resultant composite may be undesirably stiff for some applications, but this of course is somewhat dependent upon selection of polymer composition, some being softer and more pliable than others. There are some applications which might require such a stiff backing and thus the selection of the polymer depends on the end use. When employing harder, stiffer polymers, the composite becomes excessively stiff for many applications if the polymeric layer is thicker than about 1750 micrometers.

The continuous polymeric layer can be formed from polymerization of liquid reactants. Useful reactive polymer systems include thermal or radiation cured urethane and epoxy resins. One such liquid reactive system is the two-part laminate adhesive composition described in Example 1 of U.S. Pat. No. 4,331,453 (Dau et al.) In some embodiments, the continuous polymer layer is a thermally (melt) extruded polymer. Thermoplastics such as nylons, polyesters, polypropylene, polyethylene/vinyl acetate copolymers, acrylic/butadiene/styrene copolymers and the like, and thermoplastic elastomers such as ionomers, polyesters, polyurethanes, polyamide ethers, and the like are examples of suitable melt extrudable polymers. The polymeric layer may also contain, for example, compatible fillers, pigments, short reinforcing fibers, antioxidants, lubricants, etc.

Exemplary cloth strips and tapes (i.e., strips with an adhesive)) include woven polyester fabric and tapes. Useful fabrics are plain weave, having at least 16 ends per inch, but no more than 20 ends per inch in both directions. It is typically more desirable if the fabrics are cut from the woven fabric at a bias angle of about 67 degrees. Typically it is desirable for the cloth strip or tape thickness to be ±0.002 of the average thickness. Typically, the cloth strip or tape has a thickness in a range from about 0.004 inch to about 0.008 inch (in some embodiments, about 0.006 inch), although thickness outside this range may also be useful.

Exemplary polymeric strips and tapes (i.e., strips with an adhesive) include polymeric films and tapes (typically with at least 150 pounds per inch width breaking strength (as determined by the Tensile Test described below in the Examples) and have a generally uniform thickness). The polymeric strips and tapes have relatively high flex- and abrasion-resistance. Typically, the polymeric strip or tape has a thickness in a range from 0.004 inch to about 0.008 inch (in some embodiments, about 0.006 inch), although thickness outside this range may also be useful. Typically it is desirable for the polymeric strip or tape thickness to be ±0.002 of the average thickness. Useful polymeric strips are commercially available, and include, for example, polyamide films. Use of the polymeric strip is observed to increase the wear resistance of the endless abrasive belt during use.

Useful adhesives for the cloth and polymeric strips and tapes are those that are compatible with the materials they are securing together, and which provide sufficient adhesion when the belt is in use. Exemplary adhesives include polyesterurethane and polyurethane adhesives.

Endless abrasive belts according to the present invention can be made in a variety of ways. For example, embodiments of the present invention can be made by a method comprising:

providing an initial endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the nonwoven layer having abutted first and second ends;

a continuous polymeric layer attached to and substantially covering one major surface of the nonwoven layer except for regions adjacent the first and second ends, said first and second ends having first and second major surface areas, respectively; and a cloth strip adhesively attached to the first and second major surface areas to secure the first and second ends together, the cloth strip having an outer major surface; and applying a polymeric strip to adhesively attach and substantially cover the outer major surface of the cloth strip to provide the endless abrasive belt.

Embodiments of the present invention can be made by a method comprising:

providing an initial endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the nonwoven layer having abutted first and second ends; and a continuous polymeric layer attached to and substantially covering one major surface of the nonwoven layer except for regions adjacent the first and second ends, said first and second ends having first and second major surface areas, respectively; and applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

Embodiments of the present invention can be made by a method comprising:

providing an endless abrasive belt comprising a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

applying a continuous polymeric layer attached to and substantially cover one major surface of the nonwoven layer except for regions adjacent the first and second ends, said first and second ends having first and second major surface areas, respectively;

applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

Embodiments of the present invention can be made by a method comprising:

providing an endless abrasive belt comprising a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

applying a continuous polymeric layer attached to and substantially cover one major surface of the nonwoven layer;

substantially removing a portion of the polymeric layer to provide regions adjacent the first and second ends, said first and second ends having first and second major surface areas, respectively;

applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

Typically, it is desirable for the thickness of endless abrasive belts according to the present invention to have a substantially uniform thickness (i.e., the thickness along the length of the belt is within ±0.002 inch of the average thickness of the belt. The thickness of the belt can be measured using a micrometer or a visual microscope with a measuring eyepiece (such as "Wild M38" Wild Company, Heerbrugg, Switzerland. Therefore the thickness of the components of the endless abrasive belt, including the cloth strip or tape and polymeric strip or tape are desirably selected and arranged such that the resulting belt has a substantially uniform thickness. Having a substantially uniform thickness is desirable because it tends to have reduced chatter that tends to occur during use as a result of splices that are substantially different in thickness compared to the remainder of the belt. Chatter may increase operator fatigue and/or lead to undesirable marking of the workpiece surface.

Figure 2:
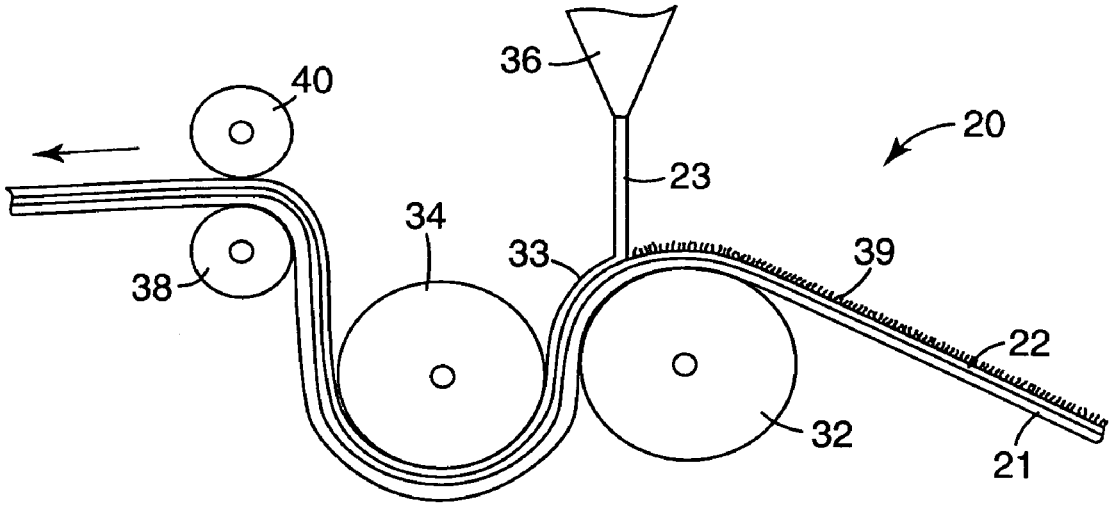
FIG. 2 is a schematic of an exemplary splice to make embodiments of endless abrasive belts according to the present invention.

FIG. 2 illustrates an exemplary method of the partial manufacture of an exemplary endless abrasive belt according to the present invention. Laminate 20 comprises a lofty nonwoven web 21 secured to a reinforcing fabric (e.g., woven cloth) 22 is fed into a coating process with fibers 39 protruding through fabric 22. (In some embodiments, the nonwoven web 21 is previously needled to fabric 22, a liquid binder is applied to the nonwoven web, and the binder is allowed to cure.) The laminate is fed under extruder 36 having a die opening capable of forming a sheet 23 of molten polymer. Sheet 23 is directed onto fabric 22 side of laminate 20 to engulf protruding fibers 39 to form polymer layer 33. Counter rotating rollers 32 and 34 are spaced to apply a force on opposed surfaces of the laminate to smooth the surface of polymer layer 33. Rotating roller 34 is chilled such that polymer layer 33 solidifies after contacting roller 34. Nip rolls 38 and 40 guide the resultant coated laminate to a storage roll (not shown) or to a cutting station (not shown) where the coated laminate may be cut to size and shape.

The resulting article can be made into embodiments of endless abrasive belts according to the present invention by substantially removing a portion of the polymeric layer to provide regions adjacent the first and second ends having first and second major surface areas, respectively (i.e., removing at least sufficient polymeric material to provide a surface to attach the cloth tape), applying a cloth strip to adhesively attach the first and second major surface areas to secure the first and second ends together, and applying a polymeric strip to adhesively attach and substantially cover the outer major surface of the cloth strip to provide the endless abrasive belt.

An automated method for removing a portion of the polymeric material in preparation for applying the cloth strip is to employ a router (such as those available from Jehren Industries, Inc, Rockford, Ill.). For example, abutted ends of the nonwoven web can be clamped in place on a worktable or the like with a router assembly. The depth of cut of the router is set so only the desired amount of polymeric material is removed.

Embodiments of endless abrasive belts according to the present invention are useful, for example, to remove corrosion, surface defects, burrs, and impart desirable surface finishes on various articles such as those made of aluminum, brass, copper, steel, wood, and the like. Typically endless abrasive belts according to the present invention are used with sanding equipment, such as a stroke sander.

An embodiment of this invention is further illustrated by the following examples, but the particular materials and amounts thereof recited in these examples, as well as other conditions and details, should not be construed to unduly limit this invention. All parts and percentages are by weight unless otherwise indicated The table below provides a description of the raw materials used for the examples.

TABLE

| Reference Designation | Material |
|---|---|
| AD1 | 100 parts polyesterurethane adhesive prepolymer (obtained under the trade designation "A067000-20" from (Sheldahl Co., Northfield, MN) premixed with 0.25% 2-ethyl,4-methylimidazole, and 12 parts triphenylmethane triisocyanate, 27% solution in ethyl acetate (obtained under the trade designation "DESMODUR RE" from Bayer Polymers LLC, Pittsburgh, PA) |
| AD2 | 100 parts polyurethane adhesive prepolymer (obtained under the trade designation "BOSTIK L7070" from Bostik Findley, Inc., Wawatosa, WI) and 0.094 part hardener (obtained under the trade designation "BOSCODUR 2E" from Bostik Findley, Inc.) |
| ST1 | 1-inch wide plain-weave cloth splicing tape having 18 yarns per inch in both the warp and filling directions and cut on a bias of 67° such that when positioned across the splice, the yarns ran parallel to the belt, in the length direction. The splice tape tensile was 120 to 180 pounds and the splicing tape was coated to a dry add-on of 1.2 gram per 2-foot length with AD1. |
| ST2 | 1-inch wide a polyamide film tape (obtained under the trade designation "Gold Reinforced Polyamide Film Tape" from Sheldahl Corp., Northfield, MN; polyamide film splicing tape with reinforcing fibers imbedded at 67° to the length direction; tape is wear resistant. Coated to a dry add-on of 1.2 gram per 2-foot length with AD1 |
| ST3 | The same as ST1, except coated to a dry add-on of 1 gram per 2-foot length with AD2 instead of AD1 |

EXAMPLE

A film-backed nonwoven endless abrasive belt according to the present invention was made as follows. A 12-inch wide×200 inch long roll of nonwoven abrasive material that was uniformly extrusion coated (at 520° F.) onto the backside with 7 grams/24 in.$^2$ of nylon 6 ("ULTRAMID B-3", BASF Corporation, Florham Park, N.J.). The ends to be joined into an endless belt were cut at a 67° angle. The nonwoven abrasive material used is marketed by 3M Company, St. Paul, Minn. under the trade designation "A-CRS, Low Stretch SCOTCH-BRITE Surface Conditioning Material" (this nonwoven abrasive material includes ANSI 60–80 alumina abrasive particles and a scrim obtained from Milliken & Company, LaGrange, Ga. under the trade designation "Poly Cloth Power Strate Scrim 56" Polyester Sateen High Tenacity"). At each end, a one-inch wide strip of the polymer film backing was removed from the back of the abrasive belt using a utility knife. The ends were then abutted and a layer of adhesive ("AD1") brushed onto the exposed backside of the nonwoven abrasive material. A strip of splicing tape ("ST1") was then applied across the abutted ends so that the coated side of the splicing tape was in contact with the layer of adhesive on the nonwoven abrasive material.

The resulting composite was allowed to air-dry at ambient conditions for about 30 minutes. The air-dried composite was then placed in a heated hydraulic press ("Model 2 OT-12SP", Co-Ab-Co, Chicago, Ill.) and pressed at about 1600–1800 psi for about 15 seconds at 220° F. The press was opened, the belt inverted, and the composite was pressed for an additional 15 seconds under the same conditions. The composite was then removed from the press and another layer of adhesive ("AD1") was brushed onto the surface of the splicing tape ("ST1"). A strip of ST2 was then applied so that the coated side of ST2 was in contact with the newly-applied layer of adhesive ("AD1"). The composite was then allowed to air-dry at ambient conditions for 15 minutes. The air-dried composite was then placed again into the heated hydraulic press and pressed, inverted, and pressed again under the same conditions.

COMPARATIVE EXAMPLE

A conventional film-backed nonwoven endless abrasive belt was made as follows. A 12-inch wide roll of film-backed nonwoven abrasive material (described in Example 1) was cut to the required length widthwise at a 67° angle. The ends were then abutted and a layer of adhesive ("AD2") brushed onto the backside of the film-backed nonwoven abrasive material. A strip of splicing tape ("ST3") was then applied across the abutted ends so that the coated side of the splicing tape was in contact with the layer of adhesive on the film-backed nonwoven abrasive material.

The resulting composite was allowed to air-dry at ambient conditions for about 1.5 hour. The air-dried composite was then placed in a heated hydraulic press ("150 Ton", K. R. Wilson Co., Avcade, N.Y.) and pressed at 50–80 tons for about 20 seconds at 230° F.

Tensile Test 12-inch×1-inch wide test specimens were cut such that the splice to be evaluated was located halfway along the 12-inch length. At least 50 belts for each of the Example and Comparative Example were tested, and there were two samples tested from each of these belts. Test specimens were mounted in an electronic tensile testing machine ("LS500" with 500-lb load cell, from Lloyds Beal Ltd., Cardiff, UK) using 2-inch wide pneumatic grips set to provide a 5-inch gauge length. The rate of grip separation was 10-inches per minute. The average load to break data in pounds per 1-inch width for the Example and Comparative Example was about 243 and about 141, respectively.

Various modifications and alterations of this invention will become apparent to those skilled in the art without departing from the scope and spirit of this invention, and it should be understood that this invention is not to be unduly limited to the illustrative embodiments set forth herein.

What is claimed is:

1. An endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

a continuous polymeric layer attached to and substantially covering one major surface of the nonwoven layer except for regions adjacent the first and second ends, said first and second ends having first and second major surface areas, respectively;

a cloth strip adhesively attached to the first and second major surface areas to secure the first and second ends together, the cloth strip having an outer major surface; and a polymeric strip adhesively attached to and substantially covering the outer major surface of the cloth strip.

2. The endless abrasive belt according to claim 1, wherein the synthetic fibers comprise nylon fibers.

3. The endless abrasive belt according to claim 1, wherein the continuous polymeric layer encapsulates the one major surface of the nonwoven layer with fibers from the nonwoven layer extending into and terminating in the polymeric layer to provide a surface which has substantially no fibers protruding there from.

4. The endless abrasive belt according to claim 1, wherein the continuous polymeric layer has a thickness of about 175 micrometers to 1750 micrometers, and wherein the nonwoven layer having a Shore A durometer ranging from about 25 to 85.

5. The endless abrasive belt according to claim 1 further comprising a reinforcing fabric situated between said polymeric layer and said nonwoven layer, said fibers from said nonwoven layer extending through said fabric and into said polymeric layer.

6. The endless abrasive belt according to claim 5, wherein the fabric is a scrim needle tacked to the lofty web.

7. The endless abrasive belt according to claim 1, wherein said polymeric layer is melt extruded.

8. The endless abrasive belt according to claim 1, wherein the polymeric layer comprises a polymer selected from the group consisting of nylon, polyester, polypropylene, polyethylene/vinyl acetate copolymer, acrylic/butadiene/styrene copolymer, polyurethane, and polyamide ethers.

9. The endless abrasive belt according to claim 1, wherein the polymeric strip comprises polyamide.

10. The endless abrasive belt according to claim 1, wherein the polymeric strip is a polyamide tape.

11. The endless abrasive belt according to claim 10, wherein the cloth strip is a cloth tape.

12. The endless abrasive belt according to claim 1 having a substantially uniform thickness.

13. A method for making the endless abrasive belt according to claim 1, the method comprising:

providing an initial endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the nonwoven layer having abutted first and second ends;

a continuous polymeric layer attached to and substantially covering one major surface of the nonwoven layer except for regions adjacent the first and second ends, said first and second ends having first and second major surface areas, respectively; and a cloth strip adhesively attached to the first and second major surface areas to secure the first and second ends together, the cloth strip having an outer major surface; and applying a polymeric strip to adhesively attach and substantially cover the outer major surface of the cloth strip to provide the endless abrasive belt.

14. The method of making the endless abrasive belt according to claim 13, wherein the polymeric strip comprises polyamide.

15. A method for making the endless abrasive belt according to claim 1, the method comprising:

providing an initial endless abrasive belt comprising:

a nonwoven three-dimensional layer comprising an open, lofty web of crimped synthetic fibers that are adhesively bonded substantially at points of mutual contact with a binder material, the binder material comprising a plurality of abrasive particles, the nonwoven layer having abutted first and second ends; and a continuous polymeric layer attached to and substantially covering one major surface of the nonwoven layer except for regions adjacent the first and second ends, said first and second ends having first and second major surface areas, respectively; and applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

16. The method of making endless abrasive belt according to claim 15, wherein the polymeric strip comprises polyamide.

17. A method for making the endless abrasive belt according to claim 1, the method comprising:

providing an endless abrasive belt comprising a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

applying a continuous polymeric layer attached to and substantially cover one major surface of the nonwoven layer except for regions adjacent the first and second ends, said first and second ends having first and second major surface areas, respectively;

applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

18. The method of making the endless abrasive belt according to claim 17, wherein the polymeric strip comprises polyamide.

19. A method for making the endless abrasive belt according to claim 1, the method comprising:

providing an endless abrasive belt comprising a nonwoven three-dimensional layer comprising an open, lofty web of crimped synthetic fibers that are adhesively bonded substantially at points of mutual contact with a binder material, the binder material comprising a plurality of abrasive particles, the non-woven layer having abutted first and second ends;

applying a continuous polymeric layer attached to and substantially cover one major surface of the nonwoven layer;

substantially removing a portion of the polymeric layer to provide regions adjacent the first and second ends, said first and second ends having first and second major surface areas, respectively;

applying a cloth strip to adhesively attach the first and second major surface areas to secure the first and second ends together, the cloth strip having an outer major surface; and applying a polymeric strip to adhesively attach and substantially cover the outer major surface of the cloth strip to provide the endless abrasive belt.

20. The method of making the endless abrasive belt according to claim 19, wherein the polymeric strip comprises polyamide.

* * * * *

UNITED STATES PATENT AND TRADEMARK OFFICE

CERTIFICATE OF CORRECTION

PATENT NO. : 7,134,953 B2
APPLICATION NO. : 11/022961
DATED : November 14, 2006
INVENTOR(S) : Paul R. Reinke It is certified that error appears in the above-identified patent and that said Letters Patent is hereby corrected as shown below:

Column 7
Line 26, after "indicated" insert -- . --.

Line 40, after "PA)" insert -- . --.

Line 56, after "AD1" insert -- . --.

Line 58, after "AD1" insert -- . --.

Column 10
Line 35, in claim 16, after "making" insert -- the --.

Signed and Sealed this

Third Day of April, 2007

JON W. DUDAS
*Director of the United States Patent and Trademark Office*